US008968622B2

(12) United States Patent
Kuhnle et al.

(10) Patent No.: US 8,968,622 B2
(45) Date of Patent: Mar. 3, 2015

(54) DEVICE AND METHOD FOR EJECTING AT LEAST ONE CAPSULE

(75) Inventors: Manfred Kuhnle, Schwaikheim (DE); Ralf Schmied, Freiberg (DE); Werner Runft, Winnenden (DE); Thomas Franck, Lorch-Weitmars (DE)

(73) Assignee: Robert Bosch GmbH, Stuttgart (DE)

( * ) Notice: Subject to any disclaimer, the term of this patent is extended or adjusted under 35 U.S.C. 154(b) by 1250 days.

(21) Appl. No.: 12/305,749

(22) PCT Filed: Jul. 3, 2007

(86) PCT No.: PCT/EP2007/056659

§ 371 (c)(1),
(2), (4) Date: Dec. 19, 2008

(87) PCT Pub. No.: WO2008/015065

PCT Pub. Date: Feb. 7, 2008

(65) Prior Publication Data

US 2010/0164144 A1 Jul. 1, 2010

(30) Foreign Application Priority Data

Jul. 31, 2006 (DE) ..... 10 2006 035 280

(51) Int. Cl.
*B28B 13/06* (2006.01)
*A61J 3/07* (2006.01)

(52) U.S. Cl.
CPC ..... *A61J 3/074* (2013.01); *A61J 2200/74* (2013.01)
USPC ..... 264/334; 425/139

(58) Field of Classification Search
CPC ..... A61J 3/07; A61J 3/074
USPC ..... 264/334; 53/900, 560, 454
See application file for complete search history.

(56) References Cited

U.S. PATENT DOCUMENTS

| | | | | |
|---|---|---|---|---|
| 5,018,335 | A | 5/1991 | Yamamoto et al. | |
| 6,434,911 | B1 | 8/2002 | Yamamoto et al. | |
| 6,834,475 | B2 * | 12/2004 | Trebbi et al. | 53/253 |
| 2007/0044433 | A1 * | 3/2007 | Runft et al. | 53/281 |

FOREIGN PATENT DOCUMENTS

| | | | |
|---|---|---|---|
| DE | 1586266 | A1 | 10/1970 |
| DE | 10351212 | A1 | 6/2005 |
| DE | 102004048007 | A1 | 4/2006 |

* cited by examiner

*Primary Examiner* — Larry Thrower
*Assistant Examiner* — Xue Liu
(74) *Attorney, Agent, or Firm* — Michael Best & Friedrich LLP

(57) ABSTRACT

A device and a method for ejecting at least one capsule are proposed, comprising at least two ejecting mechanisms for ejecting at least one capsule from a holder receiving the capsules. A drive control mechanism is provided in order to move the ejecting mechanisms independently of one another in the ejecting direction, depending on whether the capsule assigned to the ejecting mechanism is detected as defective.

4 Claims, 5 Drawing Sheets

DEVICE AND METHOD FOR EJECTING AT LEAST ONE CAPSULE

CROSS-REFERENCE TO RELATED APPLICATION

This application is a 35 USC 371 application of PTC/EP 2007/056659 filed on Jul. 3, 2007.

BACKGROUND OF THE INVENTION

1. Field of the Invention

The invention is based on a device and a method for ejecting at least one capsule.

2. Description of the Prior Art

One device of this generic type is already known from German Patent Disclosure DE 103 51 212 A1. A machine for filling and closing two-piece capsules includes a capsule ejector for axially ejecting the capsules from their respective receptacle. Guide flaps that are individually triggerable and can be pivoted relative to a pivot axis and are each associated with one capsule receptacle are provided. They each include two guide tracks for the respective associated capsule. The ejected capsule is put on either one or the other guide track, depending on whether the capsule is in order or is defective. As a result, capsules that are in order are separated from defective capsules.

OBJECT AND SUMMARY OF THE INVENTION

However, this device is relatively complex. It is therefore the object of the present invention to disclose a device and method that in a simple way enable individual capsule ejection. This object is attained by the characteristics of the dependent claims.

The device of the invention and the method for ejecting at least one capsule have the advantage over the prior art that multiple ejecting mechanisms can already be triggered individually and independently of one another. As a result, it becomes possible, in the event of a defective capsule, to discard that capsule individually. Because the motion of the ejecting mechanism, which in particular is ejecting a defective capsule, is varied in a targeted way, downstream sorting devices can be dispensed with. According to the invention, only the ejecting mechanisms which are intended to lead to an ejection of that particular capsule are moved upward. In a following station, all the capsules that still remain can then be ejected. The resultant device is relatively simple in construction, since a suitable drive construction must be provided anyway for moving the ejecting mechanisms. All that is additionally needed is to provide individual control elements, for instance in the form of pneumatic cylinders, for each ejecting mechanism individually, and these control elements assure that depending on the desired capsule rejection, the appropriate ejecting mechanism is moved in the ejection direction together with the carriage.

In an expedient refinement, it is provided that the slaving control means include a carriage that is movable in the ejection direction. By way of this carriage, the various ejecting mechanisms can be moved in the ejection direction, regardless of which ejecting mechanisms is supposed to eject the associated capsule at that time or not. This simplifies the drive construction, since only a single part has to be set in motion.

In an expedient refinement, it is provided that the slaving control mechanism put the applicable ejecting mechanism into communication with the carriage in such a way that this ejecting mechanism is movable in the ejection direction together with the carriage. According to the invention, the slaving control mechanism is thus disposed on the carriage, thereby making a space-saving construction possible. The slaving control mechanism can now act directly on the ejecting mechanisms, which are preferably guided in the carriage.

In an expedient refinement, it is provided that as control elements, cylinders, in particular pneumatic cylinders, are used. These are distinguished by easy triggering.

BRIEF DESCRIPTION OF THE DRAWINGS

One exemplary embodiment is shown in the drawing and will be described in further detail below, in which.

DESCRIPTION OF THE PREFERRED EMBODIMENT

Figure 1:
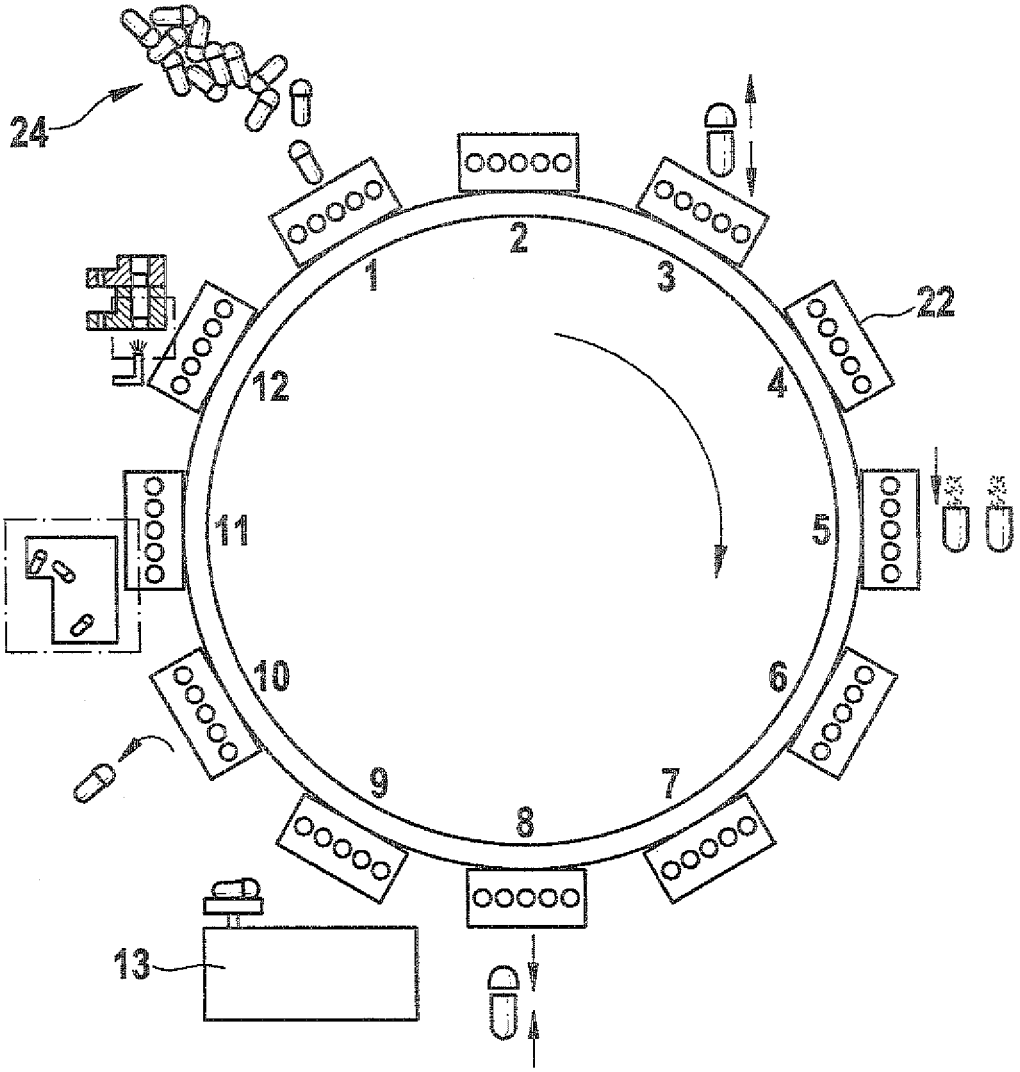
FIG. 1 shows a basic top view on a capsule filling and closing machine, in which the device for ejecting at least one capsule is employed.
Figure 2:
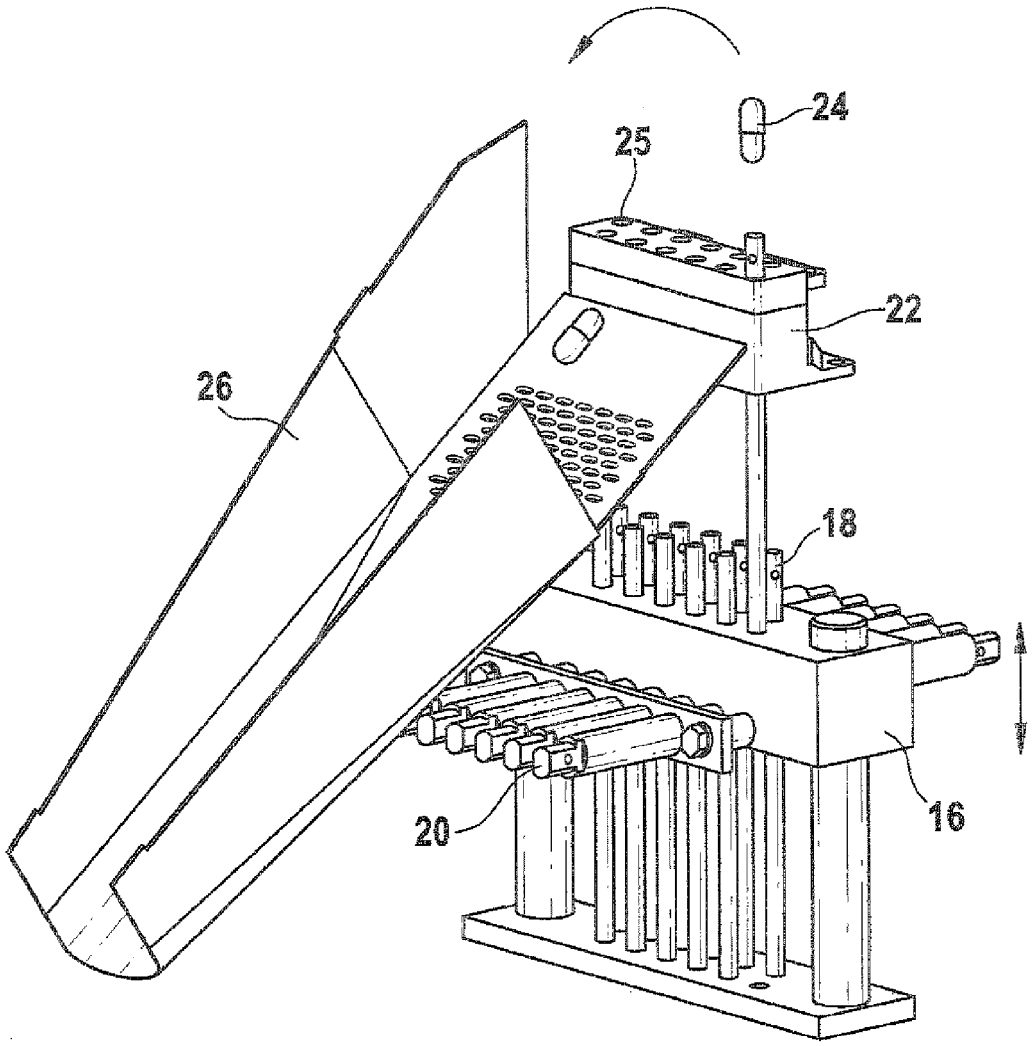
FIG. 2 is a perspective view of the essential components of an ejection device.

In FIG. 1, a machine is shown for filling and closing capsules 24, which each comprise one lower capsule part and one upper capsule part. As a capsule conveyor, the machine includes a conveyor wheel which rotates in increments about a vertical axis, and by means of which twelve work stations 1 through 12 can be approached. The capsule conveyor includes twelve holders 22 for this purpose, in each of which five receptacles, for instance, each for one capsule 24, are embodied. The individual work stations 1 through 12 of the machine have different tasks upon filling of the capsules 24. For instance, in work station 1, the put-together capsules 24 are sorted and placed in the receptacles in the holders 22. After a rotation of the conveyor wheel to work station 3, the capsules 24 are released there; that is, the upper capsule part is separated from the lower capsule part. Also in work station 3, the upper capsule parts of the capsules 24 placed in the holders are tested for their quality. Upon the approach to work station 5 by the holders 22, the capsules 24 are filled by a powder filling station. Once the lower capsule parts have been filled, the capsules are closed again in work station 8. In work station 9, the capsules 24 are weighed. In this operation it is checked whether capsules 24 have been filled with enough powder. Based on this weighing, it is decided whether the capsule has been properly filled, or incorrectly filled. Incorrectly filled capsules 24 are ejected in the next work station 10 by the corresponding ejection device, which will be described in further detail below. In work station 11, all the capsules 24 that remain in the holder 22 and are in order are ejected and are transferred for instance to a following packaging device, such as a blister pack machine. In work station 12, cleaning of the holder 22 is done, for instance by blown air.

The device for ejecting at least one capsule 24 will now be described in further detail in conjunction with FIGS. 2 through 5. This device comprises a carriage 16, which can be moved up and down in the ejection direction. In the carriage 16, as many ejecting means 18 are guided as there are receptacles 25 in the holder 22 for the corresponding capsules 24. Pneumatic cylinders 20, as an example for slaving control means, are disposed on the carriage 16. Capsules 24 ejected by ejecting means 18 are diverted via a capsule groove 26.

Figure 3:
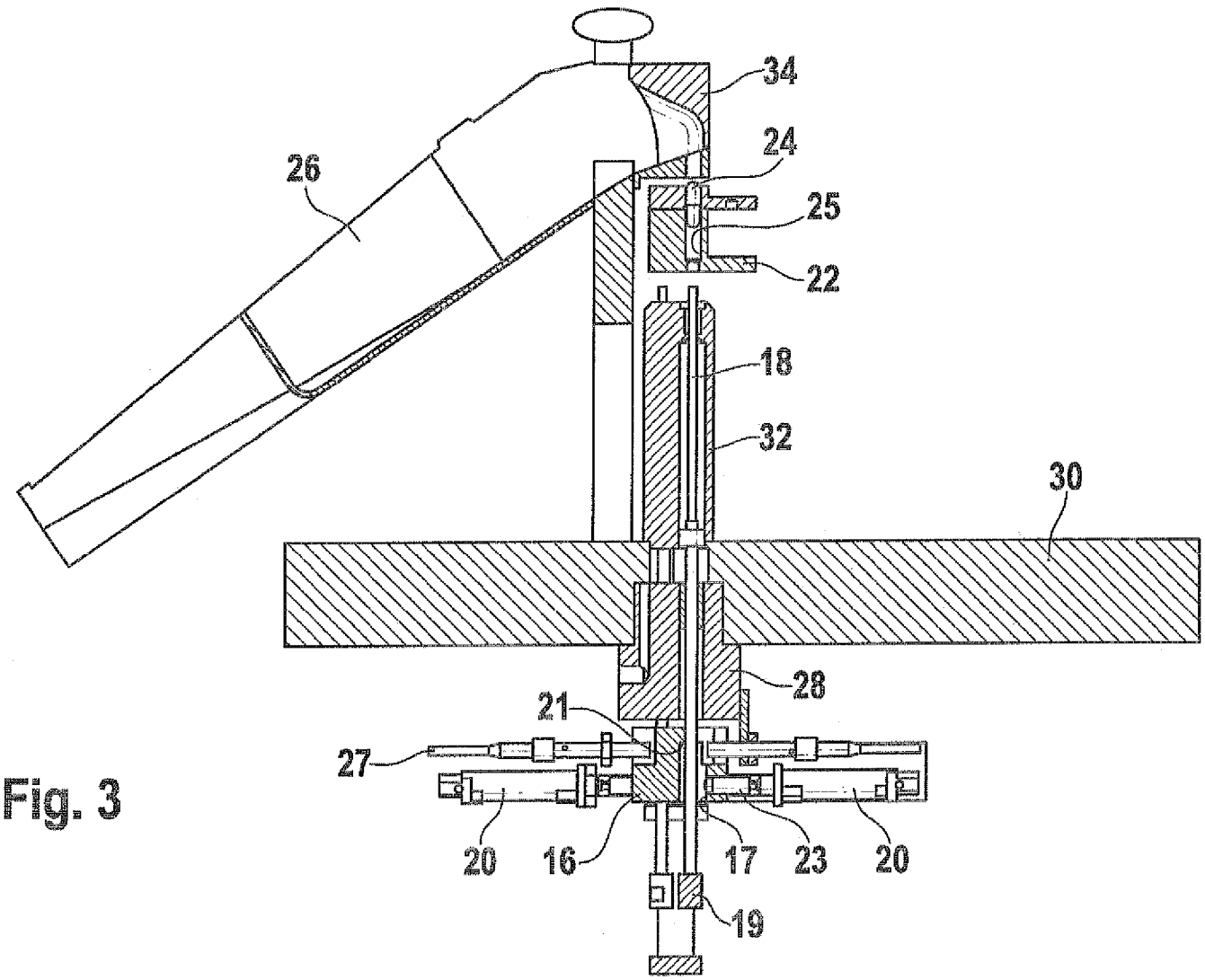
FIG. 3 is a sectional view of the ejection device, in a position in which the carriage is in the upper position, but no capsule ejection is intended.
Figure 4:
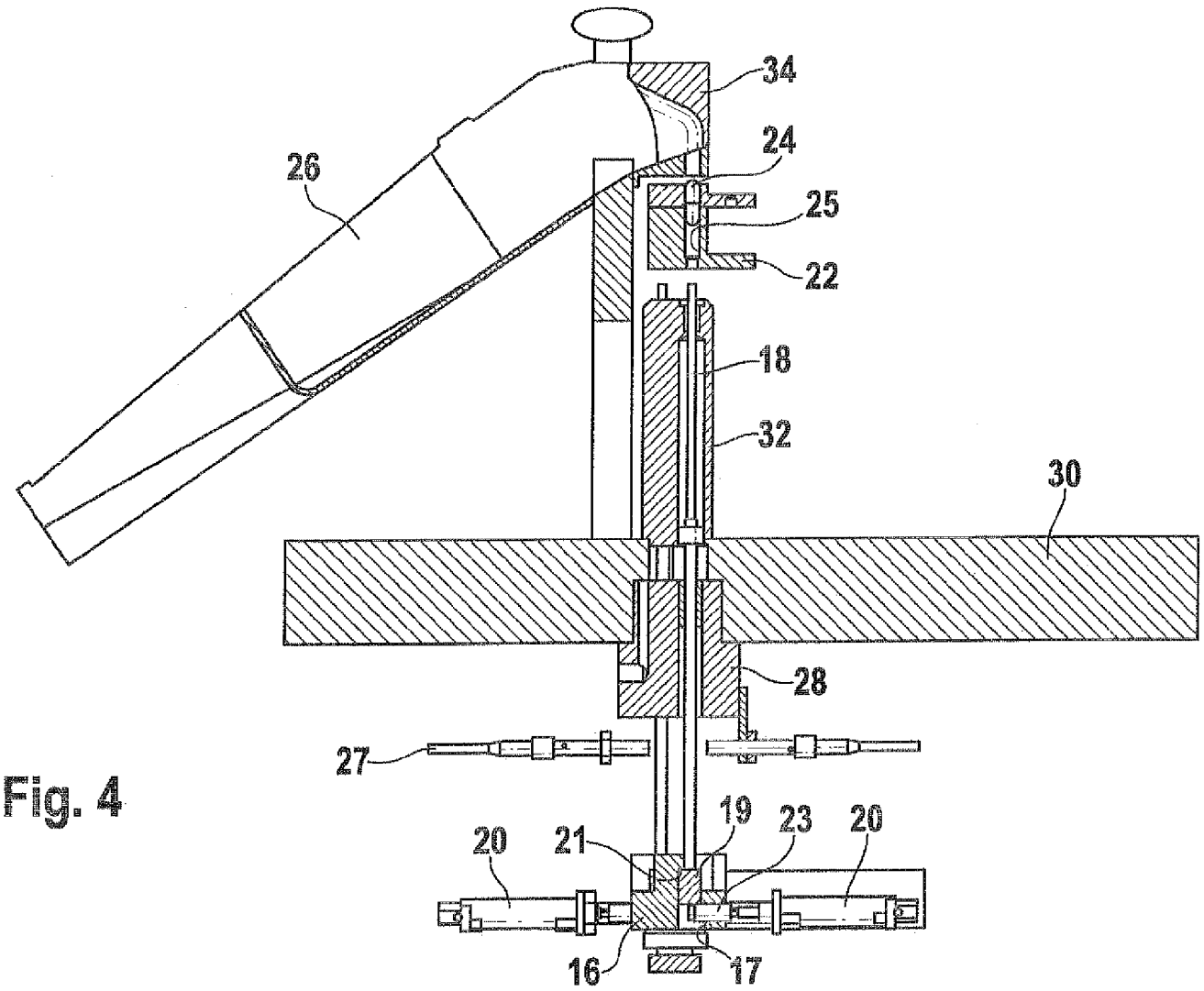
FIG. 4 shows the ejection device in the lower slide position, for preparing a capsule ejection.
Figure 5:
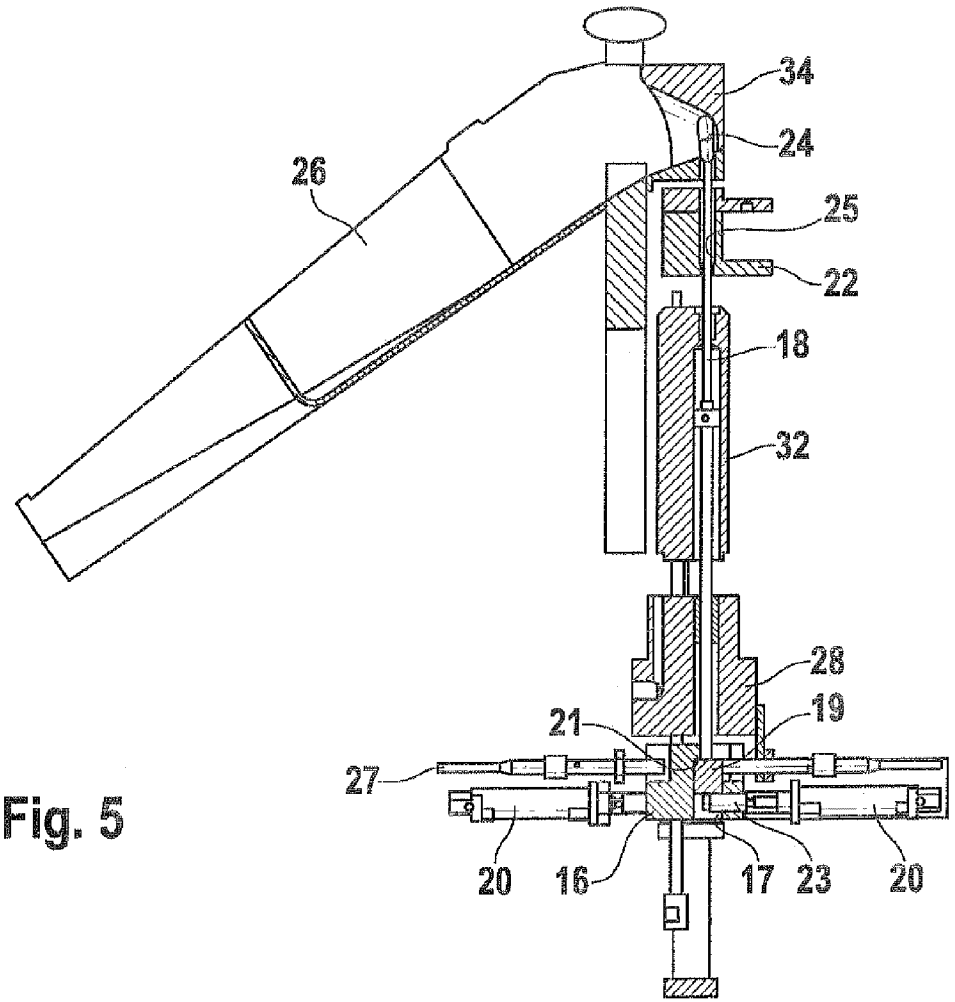
FIG. 5 shows the ejection device in its ejection position.

In FIGS. 3 through 5, the mechanism that makes individual triggering of the ejecting means 18 possible is shown in further detail. The carriage 16 includes recesses 17, corresponding to the number of ejecting means 18. These recesses 17 are dimensioned such that upon an up-and-down motion of the carriage 16, the ejecting means 18 are not moved. Pneumatic cylinders 20 are also mounted on the carriage 16, corresponding to the number of ejecting means 18. Respective control pistons 23 of the pneumatic cylinders 20, via corresponding transverse bores, reach in the direction of the respective recess 17. Above the pneumatic cylinders 20, suitable sensors 27, depending on the number of applicable ejecting means 18, are disposed that serve to monitor the position and to control the ejecting means 18. At the end of the ejecting means 18, there is a part that is widened somewhat compared to the tappet with a slaving face 19. This slaving face 19 cooperates with a shoulder 21 in the recess 17, so that the ejecting means 18 cannot exit from the carriage 16 at the top. The device for ejecting at least one capsule 24 has a tabletop 30. A lower guide 28 and an upper guide 32 are connected by positive engagement to this tabletop 30. The two guides 28, 32 serve to guide the ejecting means 18. The respective ejecting means 18 reach the corresponding capsule receptacle 25 in the holder 22 via a bore. In the ejection position, the holder 22 is located below its deflector 34, which deflects an ejected capsule 24 in the direction of the capsule groove 26.

The ejection device functions as follows: The motion of the plurality of ejecting means 18 is controlled via a single carriage 16. Depending on the cycle of the conveyor wheel, the carriage 16 moves one time per cycle in the ejection direction. From FIG. 3, it can be seen that the carriage 16 is in the upper position. However, the ejecting means 18 shown is in its lower position. This means that the capsule 24 associated with this ejecting means 18 is not to be ejected. In that case, the motion of the carriage 16 from below in the ejection direction does not act on the motion of the ejecting means 18; in other words; the ejecting means 18 remains in its position. The recess 17 is designed such that the motion of the carriage 16 does not cause a motion of the corresponding ejecting means 18.

In the next cycle, the carriage 16 is moved back to its lower position, as shown in FIG. 4. In the lower position, the slaving face 19 of the ejecting means 18 rests on the shoulder 21 of the recess 17 in the carriage 16. The slaving face 19 extends downward so far that, via a lateral opening, the control piston 23 can act on the underside of the slaving face 19. Depending on whether the applicable ejecting means 18 is now meant to lead to a capsule ejection or not, the corresponding control pistons 23 are driven outward in the direction of the recess 17. Those ejecting means that are not meant to lead to a capsule ejection are not put into communication with the associated control piston 23. In FIG. 4, the slaving position of the ejecting means 18 is shown; that is, the control piston 23 of the pneumatic cylinder 20 is cooperating with the underside of the slaving face 19, so that upon a corresponding upward motion of the carriage 16, the corresponding ejecting means 18 is carried along upward as well, together with the pneumatic cylinder 20 and the control piston 23. What is essential here is that the various ejecting means 18 can be triggered independently of one another for slaved motion by suitably associated control pistons 23. This makes it possible for capsules 24 to be ejected individually to be detected in a targeted way from the ejection motion of the corresponding ejecting means 18 that are moved by the carriage 16. After the corresponding assumption of the slaving position of the control piston 23, the carriage 16 is now moved in the ejection direction. The associated sensors 27 monitor whether the upper position of the respective ejecting means 18 is reached. The sensors 27 are disposed in stationary fashion relative to the carriage 16. They are embodied as proximity sensors. The ejecting means 18 are moved in the ejection direction so far that the capsule 24 is spun out of the capsule receptacle 25 in the holder 22 and deflected by the deflector 34 toward the capsule groove 26.

Various concepts for how the control pistons 23 and thus the ejecting means 18 can be individually triggered are conceivable. The goal of the device in every case is to separate incorrectly filled capsules 24 from capsules 24 that are in order. To that end, in a first variant, the defective capsules 24 can be ejected in a targeted way in the station 10. The weighing device 13 provides the information to a controller as to which of the capsules 13 are in order or defective. If in station 10 the defective capsules 24 are not to be ejected, then the control pistons 23 associated with the various defective capsules 24 and the associated ejecting means 18 are moved in the direction of the recess 17. The control pistons 23 of those ejecting means 18 that are disposed below capsules 24 that are in order are conversely not moved. Only those ejecting means 18 that are located below a defective capsule 24 are slaved in the ejection direction by the carriage 16; ejecting means 18 located below capsules 24 that are in order are not slaved in the ejection direction by the carriage 16. At the station 10, all the defective capsules 24 located in the holder 22 are expelled. After leaving the station 10, thus only the capsules 24 that are in order are in the holder 22. They are then taken out at the station 11. Now, a targeted triggering of the ejecting means 18 is no longer necessary; that is, all the ejecting means 18 can be moved into each of the capsule receptacles 25 of the holder 22, so that all the capsules 24 still located in the holder 22 can be ejected.

In a second variant, it would also be conceivable for only the capsules 24 that are in order to be ejected in station 10. Thus those control pistons 23 that are associated with the properly filled capsules 24 are triggered. Ejecting means 18 associated with defective capsules 24 are not moved in the ejection direction by the carriage 16. After leaving the station 10, in the second variant, there are then only defective capsules 24 in the holder 22. These defective capsules 24 are all ejected in work station 11. All the ejector pins in work station 11 are moved in the ejection direction and convey the defective capsules 24, still located therein, out of the holder 22.

The device and method for ejecting at least one capsule is employed especially in hard gelatin capsule filling machines. In them, the capsules can be filled with powder, pellets, liquids, or tablets. Still other methods for ascertaining a properly or incorrectly filled capsule 24 can be imagined. All that is necessary are suitable criteria by which a capsule 24 that is in order can be distinguished from a defective capsule.

The foregoing relates to the preferred exemplary embodiment of the invention, it being understood that other variants and embodiments thereof are possible within the spirit and scope of the invention, the latter being defined by the appended claims.

The invention claimed is:

1. A device for ejecting capsules, the device comprising:

a plurality of ejecting means for ejecting the capsules from a holder receiving the capsules; and a slaving control means for moving at least two ejecting means of the plurality of ejecting means in an ejection direction independently of one another, wherein the slaving control means includes a carriage movable in the ejection direction and cooperative with the at least two ejecting means, the carriage including recesses which correspond to the at least two ejecting means, in which recesses the at least two ejecting means are movably guidable relative to the carriage, and wherein the slaving control means further includes at least one cylinder mounted on the carriage and having an associated control piston configured to act on a corresponding one of the at least two ejecting means, wherein the associated control piston can be positioned in a respective recess of the corresponding one of the at least two ejecting means via the slaving control means, thereby putting the corresponding one of the at least two ejecting means into communication with the carriage for movement in the ejection direction together with the carriage.

2. A method for ejecting capsules via the device according to claim 1, the method comprising the steps of:

ejecting the capsules from the holder receiving the capsules by means of the at least two ejecting means; and moving the at least two ejecting means in the ejection direction independently of one another by means of the slaving control means, wherein ejecting the capsules means ejecting at least one capsule by executing the following steps:

lowering the carriage as part of the slaving means; and connecting the corresponding one of the at least two ejecting means to the carriage such that the connected ejecting means is moved together with the carriage in the ejection direction.

3. The method as defined by claim 2, wherein connecting the corresponding one of the at least two ejecting means to the carriage means positioning the associated control piston to act upon the one of the at least two ejecting means.

4. A device for ejecting at least one capsules, the device comprising:

a plurality of ejecting means for ejecting the capsules from a holder receiving the capsules; and a slaving control means for moving at least two ejecting means of the plurality of ejecting means in an ejection direction independently of one another, wherein the slaving control means includes a carriage movable in the ejection direction and cooperative with the at least two ejecting means, and wherein the slaving control means positions at least one of the at least two ejecting means into communication with the carriage for movement in the ejection direction together with the carriage, and further wherein individual triggering of the at least one ejection means is enabled by means of an associated control piston and pneumatic cylinder, the piston being in engagement with corresponding transverse bores disposed in the carriage in the direction of a respective recess which guides the at least one ejection means therein, the associated control piston being moved transversely to the ejection direction into the respective recess by the pneumatic cylinder.

* * * * *